US010465705B2

(12) United States Patent
Schuldt et al.

(10) Patent No.: US 10,465,705 B2
(45) Date of Patent: Nov. 5, 2019

(54) DEVICE FOR ADJUSTING A GAP BETWEEN THE HOUSING OF AN IMPELLER AND THE IMPELLER IN A RADIAL COMPRESSOR AND A TURBOMACHINE

(71) Applicant: Rolls Royce Deutschland Ltd & Co KG, Blankenfelde-Mahlow (DE)

(72) Inventors: Simon Schuldt, Koenigs Wusterhausen (DE); Knut Rosenau, Herzfelde (DE)

(73) Assignee: ROLLS-ROYCE DEUTSCHLAND LTD & CO KG, Blankenfelde-Mahlow (DE)

( * ) Notice: Subject to any disclaimer, the term of this patent is extended or adjusted under 35 U.S.C. 154(b) by 300 days.

(21) Appl. No.: 15/296,909

(22) Filed: Oct. 18, 2016

(65) Prior Publication Data

US 2017/0108004 A1 Apr. 20, 2017

(30) Foreign Application Priority Data

Oct. 19, 2015 (DE) ..... 10 2015 220 333

(51) Int. Cl.
*F04D 29/46* (2006.01)
*F04D 29/16* (2006.01)
(Continued)

(52) U.S. Cl.
CPC ..... *F04D 29/46* (2013.01); *F04D 27/0246* (2013.01); *F04D 29/162* (2013.01);
(Continued)

(58) Field of Classification Search
CPC ..... F04D 27/0246; F04D 29/4206; F04D 29/622; F01D 11/22
(Continued)

(56) References Cited

U.S. PATENT DOCUMENTS 4,687,412 A 8/1987 Chamberlain
5,054,997 A * 10/1991 Corsmeier ..... F01D 11/22 415/126
(Continued)

FOREIGN PATENT DOCUMENTS

EP 1214522 12/2004
EP 1570181 B1 11/2011
(Continued)

OTHER PUBLICATIONS

German Search Report dated Sep. 26, 2016 from counterpart German App No. 102015200333.6.

*Primary Examiner* — Dwayne J White
*Assistant Examiner* — Wesley Le Fisher
(74) *Attorney, Agent, or Firm* — Shuttleworth & Ingersoll, PLC; Timothy J. Klima

(57) ABSTRACT

A device for adjusting a gap between the housing of an impeller and the impeller in a radial compressor of a turbomachine is provided. The device comprises at least one mechanical setting device by means of which the housing of the impeller can be axially adjusted in a targeted manner for the purpose of adjusting the gap, wherein the at least one setting device can be actuated via an adjusting ring, and a transmission of a force and/or a torsional moment from the adjusting ring can be effected via at least one adjustment lever device, in particular a thread lever, or a tilting lever.

19 Claims, 7 Drawing Sheets

(51) Int. Cl.

| | |
|---|---|
| ***F04D 29/28*** | (2006.01) |
| ***F04D 29/42*** | (2006.01) |
| ***F04D 27/02*** | (2006.01) |
| ***F04D 29/62*** | (2006.01) |

(52) U.S. Cl.
CPC ..... *F04D 29/284* (2013.01); *F04D 29/4206* (2013.01); *F04D 29/622* (2013.01)

(58) Field of Classification Search
USPC ..... 415/157, 158
See application file for complete search history.

(56) References Cited

U.S. PATENT DOCUMENTS 5,263,816 A * 11/1993 Weimer ..... F01D 11/22 415/131
5,380,151 A * 1/1995 Kostka ..... F04D 27/0215 415/145
6,273,671 B1 8/2001 Ress, Jr.
7,871,241 B2 * 1/2011 Bourgeois ..... F04D 27/00 415/128
8,734,093 B2 * 5/2014 Yen ..... F04D 29/4213 415/164
9,409,228 B2 8/2016 Renard et al.
9,951,783 B2 * 4/2018 Hasegawa ..... F04D 25/02
2003/0147742 A1 8/2003 Thomas
2004/0109757 A1 6/2004 Nenstiel
2007/0172348 A1 * 7/2007 Battig ..... F01D 17/165 415/160
2008/0069690 A1 * 3/2008 Ivakitch ..... F01D 5/043 415/213.1
2008/0201324 A1 8/2008 Aronowich et al.
2011/0002774 A1 1/2011 Karafillis et al.
2011/0020120 A1 * 1/2011 Redgwell ..... F01D 17/162 415/213.1
2011/0129332 A1 * 6/2011 Behaghel ..... F01D 9/065 415/68
2013/0034425 A1 * 2/2013 Biscay ..... F04D 29/444 415/1
2013/0202428 A1 8/2013 Renard et al.
2013/0315717 A1 * 11/2013 Weule ..... F01D 17/165 415/149.1
2014/0017060 A1 1/2014 Duong et al.
2015/0016946 A1 1/2015 Ottow
2015/0192133 A1 * 7/2015 An ..... F02B 37/225 415/203

FOREIGN PATENT DOCUMENTS

FR 649330 12/1928
JP 2010031876 2/2010
WO WO2014053722 4/2014
WO WO-2014130159 A1 * 8/2014 ..... F04D 29/4206

* cited by examiner

DEVICE FOR ADJUSTING A GAP BETWEEN THE HOUSING OF AN IMPELLER AND THE IMPELLER IN A RADIAL COMPRESSOR AND A TURBOMACHINE

REFERENCE TO RELATED APPLICATION

This application claims priority to German Patent Application DE102015220333.6 filed Oct. 19, 2015, the entirety of which is incorporated by reference herein.

BACKGROUND

The invention relates to a device for adjusting a gap between the housing of an impeller and the impeller in a radial compressor and a turbomachine.

When a gap is created in a radial compressor between the impeller, i.e. the tips of the rotor blades, and the housing of the impeller, which may for example occur due to thermal effects, the efficiency of the radial compressor decreases. However, at the same time it is necessary to minimize the risk of the impeller touching at the housing during operation, so that a certain safety margin is always provided during mounting for a loss of efficiency in the course of the service life.

Devices for adjusting the gap are known from US 2014/017060 A1, U.S. Pat. No. 6,273,671 B1, US 2015/016946, US 2013/202428, WO 2014/053722 A1, US 2011/002774 A1 and U.S. Pat. No. 4,687,412 A, for example.

SUMMARY

There is the objective to create robust and efficient devices for adjusting the gap.

The objective is achieved by a device with the features as described herein.

Here, at least one mechanical setting device serves for axially adjusting the housing of the impeller in a targeted manner for the purpose of adjusting the gap, wherein the at least one setting device can be actuated—in particular in a synchronous manner—via an adjusting ring, and a transmission of a force and/or a torsional moment from the adjusting ring can be effected via at least one adjustment lever device. The adjusting ring serves for guiding forces from the at least one setting device to the at least one discrete adjustment lever device and—if multiple adjustment lever devices are present—for synchronizing the same.

This device does not require any spring elements or other energy storing devices for actuating the at least one mechanical setting device in a simple and efficient manner. Here, the gap adjustment is effected axially in parallel to the rotational axis of the radial compressor.

In one embodiment, the adjusting ring can be arranged concentrically around the rotational axis of the impeller on the suction side of the radial compressor (i.e., in front of the radial compressor), wherein the adjusting ring is movable axially and/or in the circumferential direction relative to the housing. In an alternative embodiment, the at least one adjustment lever device is arranged in a movable manner in a plane perpendicular to the rotational axis of the radial compressor. In another alternative embodiment, the at least one adjustment lever device is arranged in a movable manner in parallel to the rotational axis of the radial compressor. The arrangement and/or movability of the adjusting ring can thus be adjusted to the structural conditions in the radial compressor's environment.

In one embodiment, the axial adjustment can be effected in such a manner that by means of the adjusting ring a torsional moment can respectively be transmitted to the at least one setting device with a thread lever, wherein the torsional moment respectively creates an axially acting force inside the thread levers that serves for adjusting the housing of the impeller. This can for example be effected in such a manner that inside the thread lever the torsional moment is applied to a shaft that is axially supported at a diffuser housing, in particular by a bearing block. In one embodiment, the conversion of the torsional moment into an axially acting force is effected via a thread, in particular a flat thread, a spiral groove guide, a trapezoidal thread, a buttress thread or a round thread. A trapezoidal thread has a concentric self-centering effect.

In a further embodiment, the thread is arranged inside a nut device, wherein the nut device is coupled to a connection element for transmitting the axially acting force. Via a threaded connection, a torsional moment can be converted into a linear force, which in the present case is an axially acting force, in a simple and exact manner. This force then serves for adjusting the gap. In one of the embodiments, the connection element is a substantially rigid connection by means of which the movement of the nut device onto the housing of the impeller is effected.

In a further embodiment, the at least one adjustment lever device has respectively one jointed gear, in particular a double-jointed lever with a tilting lever, and a towing lever for converting an axial movement of the adjusting ring into an axial movement of the housing of the impeller. This shows that in principle lever gears of different designs may be used with the adjustment lever devices.

In a further embodiment, a spring device is provided as a connection to the radially connecting diffuser housing for the purpose of avoiding or minimizing a rotational movement of the housing of the impeller. The spring device can for example be configured as springy full ring that seals a transition between a radially connecting diffuser housing and the housing of the impeller.

In one embodiment, between three and twenty, preferably between five and ten, setting devices are arranged concentrically around the rotational axis in the same angular distance to each other to ensure that the gap is evenly adjusted.

In one embodiment, the housing of the impeller can additionally be mechanically coupled to a pressure chamber in such a manner that the pressure inside the pressure chamber contributes to adjusting the gap. In this manner, the compressive force that is acting on the housing of the impeller can for example have a supporting effect with respect to the axial force that comes from the at least one mechanical setting device. The at least one setting device itself can at least partially be arranged inside the pressure chamber, for example.

The objective is achieved through a turbomachine, in particular an aircraft engine, with the features as described herein.

BRIEF DESCRIPTION OF THE DRAWINGS

The invention is explained in connection with the exemplary embodiments that are shown in the Figures.

DETAILED DESCRIPTION

Figure 1:
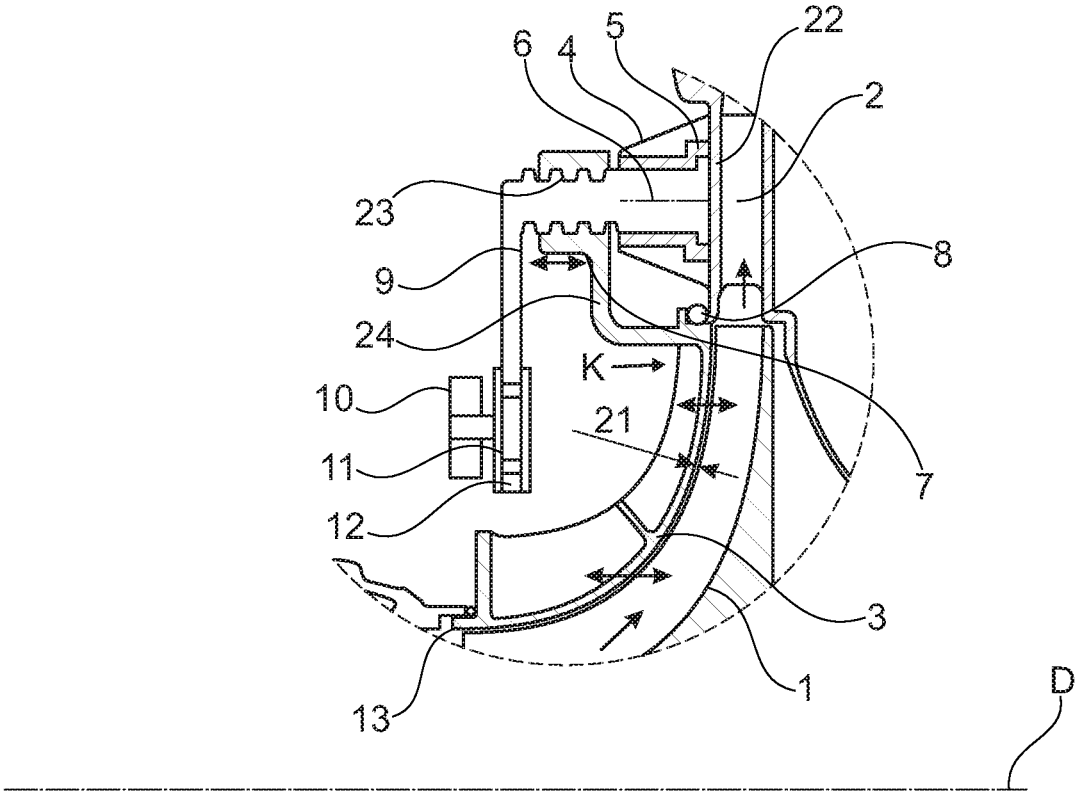
FIG. 1 shows a schematic sectional view of an embodiment of a device for adjusting a gap between the housing of an impeller and the impeller.

FIG. 1 shows a sectional view of a part of a radial compressor as it is used in turbomachines, such as aircraft engines, for example. The radial compressor has an impeller 1 that rotates around a rotational axis D. In the embodiment that is shown here, the air to be compressed flows from the left direction from the suction side substantially axially into the impeller 1 of the radial compressor, as symbolized by the arrows. An axial guidance 13 with a seal is arranged in the area of the inlet.

Inside the impeller 1, the flow is deflected into a radial direction, and then enters the diffuser 2 (stator). The desired pressure increase is then present at the exit of the diffuser.

Towards the suction side, the impeller 1 is covered by a housing 3. The diffuser 2 extends inside a diffuser housing 22. A seal 8 is arranged in the transitional area between the housing 3 of the impeller 1 and the diffuser housing 22.

An undesirably large gap 21 may occur between the impeller 1 and the housing 3 of the impeller in particular due to thermal loads. In the embodiment shown in FIG. 1, this gap 21 can be adjusted through a device that acts on the housing 3 of the impeller 1 by means of a mechanical setting device 20 that comprises multiple parts 4, 5, 6, 7.

In the following, one possibility of designing the setting device 20 is described.

For the purpose of setting the gap 21 (or the gap width), the housing 3 of the impeller 1 is embodied so as to be movable relative to the impeller 1 in particular in the axial direction. The gap can be adjusted in the desired manner through a displacement of the housing 3 in the axial direction towards the gap 21, as represented by the double arrows.

The main goal is to keep the gap at the radial compressor exit as small as possible, since it is especially in this position that wake depressions are created in the air flow due to large gaps. These then cause a loss of efficiency.

Figure 2:
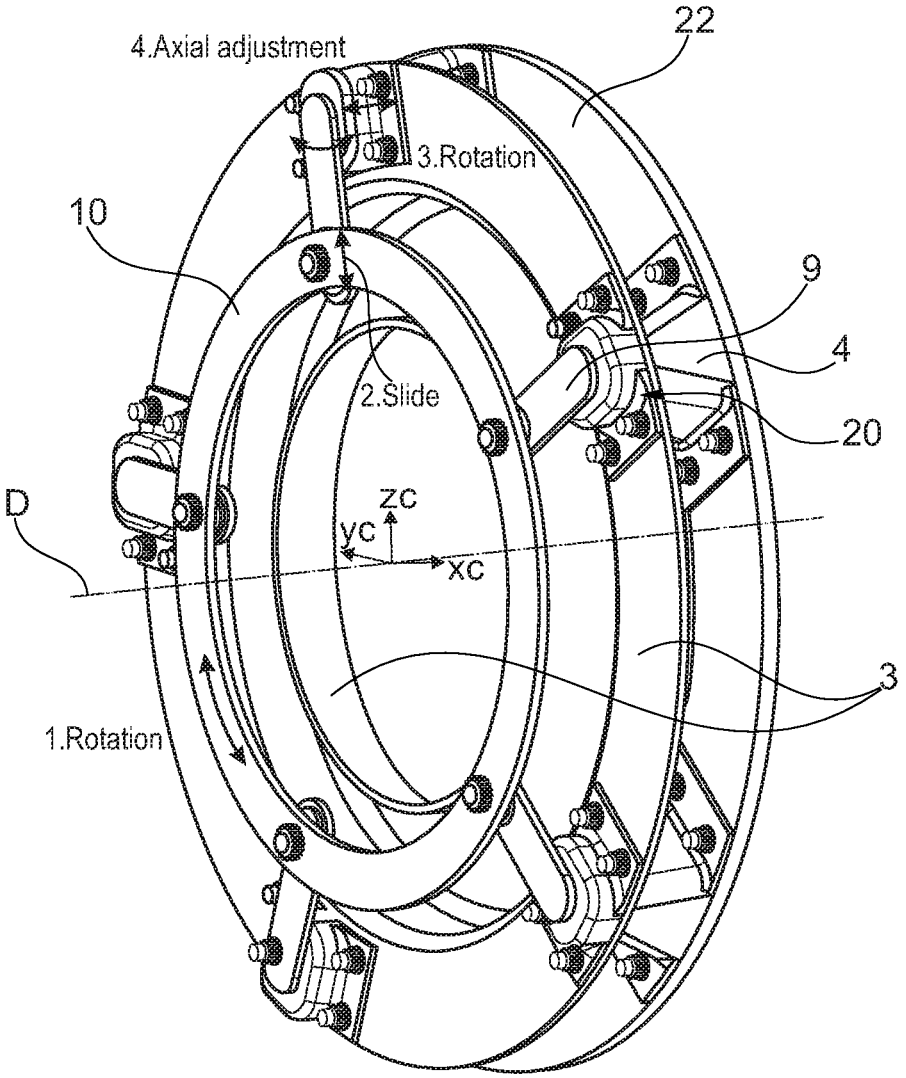
FIG. 2 shows a perspective view of setting devices and an adjusting ring that is movable around the rotational axis for an embodiment of a device according to FIG. 1, which is embodied as a thread lever with a slide stone and sliding guide.

Here, the axial movement of the housing 3 is [effected] through an adjustment lever device with a thread lever 9 that is coupled to an adjusting ring 10 via a slide stone 11 and a sliding guide 12 (as can be seen more clearly in FIG. 2). FIG. 1 shows a setting device 20 for the axial adjustment of the housing 3 of the impeller 1.

In this embodiment, the setting device 20 has a bearing block 4, with is connected to a diffuser housing 22 in a firmly fixed manner. Inside the bearing block 4, an anti-friction bush 5 with a flange is arranged, inside of which a shaft 6 is arranged that is radially mounted by means of the anti-friction bush 5. A step of the shaft 6 abuts the flange of the anti-friction bush 5, so that the shaft 6 is also axially mounted.

On the side that is facing away from the diffuser housing 22, the shaft 6 has a thread 23 that is embodied as a spiral groove here. Alternatively, also a sharp thread, a trapezoidal thread, a buttress thread, a flat thread or a round thread can be used. The shaft 6 is coupled to an adjustment lever device, so that a rotational movement at the thread lever 9 causes a rotational movement of the shaft 6.

The shaft 6 is connected to a nut device 7 via the thread 23. The nut device 7 is coupled to a housing 3 of the impeller 1 by means of a linking element 24.

In total, the setting devices 20 in this embodiment have respectively one bearing block 4 at the diffuser housing 22 and a shaft 6 in an anti-friction bush 5, wherein the shaft 6 has a thread 23 for connecting to a nut device 7, at which a linking element 24 for linkage to the housing 3 of the impeller 1 is arranged.

If a torsional moment is transmitted to the shaft 6 via the thread lever 9, the shaft 6 rotates inside the anti-friction bush 5. Because of the thread 23, the rotational movement is transmitted to the nut device 7, which as a result moves in the axial direction (see double arrows). Thus, an axial adjustment of the nut device can be effected via the adjustment lever device 9.

This axial adjustment movement is transmitted to the housing 3 of the impeller 1 via the linking element 24 that is fixedly connected to the nut device 7. In this way, the housing can be moved axially in the direction of the gap 21 or also away from the gap 21 in order to facilitate an adjustment of the gap 21.

As shown in FIG. 2, five setting devices 20 are arranged around the housing 3 of the impeller 1 around the rotational axis D at the same angular distance of 72°.

The impeller 1 and the diffuser 2 are not shown here for reasons of clarity. In alternative embodiments, also less or more setting devices 20 may be provided. In this way, the entire housing 3 of the impeller 1 can be moved in the axial direction in a targeted manner in order to adjust the gap 21.

In FIG. 2, the setting devices with the thread levers 9 are movably connected at an end with the adjusting ring 10, wherein in the embodiment according to FIG. 2 a thread lever 9 is used in combination with a slide stone and a sliding guide.

If, in the shown embodiment, the adjusting ring 10 is moved in the circumferential direction around the rotational axis D—as indicated in FIG. 2 by the double arrow and "1. rotation"—, the thread levers 9 are correspondingly deflected in a synchronous manner ("3 Rotation") via the slide stone ("2 Slide"), i.e. a rotational movement is created, which is then translated into an axial adjustment movement ("4 Axial adjustment") for the housing 3 of the impeller 1, as described in connection with FIG. 1.

Thus, the adjusting ring 10 facilitates a synchronous transmission of a rotational movement, which is then translated into a linear axial movement, in a simple manner.

In the embodiment according to FIG. 2, the thread levers 9 are arranged in combination with a slide stone and a sliding guide 12 that is preferably embodied as an oblong hole (see FIG. 1). A slide stone 11 that decreases the friction in the previously described movement is arranged between the adjusting ring 10 and the thread lever 9.

Figure 3:
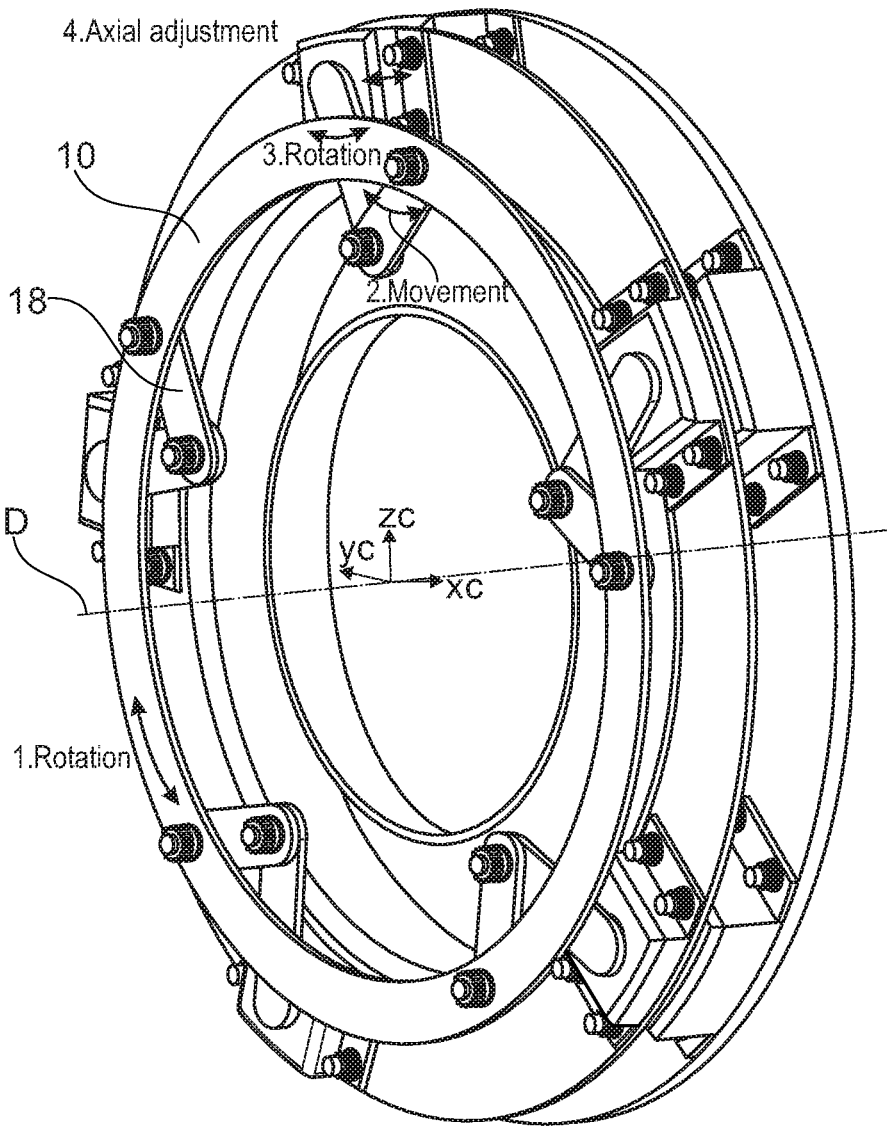
FIG. 3 shows a perspective view of setting devices and an adjusting ring that is movable around the rotational axis for an embodiment of a device, which is embodied as a thread lever with a towing lever.

FIG. 3 shows a further embodiment for adjusting the gap 21 with a thread lever 9 and a towing lever 18. In principle, this embodiment is similar to the embodiment according to FIG. 2, so that the above description may be referred to.

Here, too, the adjusting ring 10 is moved around the rotational axis D ("1. Rotation" in FIG. 3). As a result, the tilting levers 26 of the five adjustment lever devices are also rotated (see arrows, "2. Movement"). Through this rotational movement, the shaft 6, which is not shown here, is rotated ("3. Rotation"), so that the housing 3 is axially adjusted ("4. Axial adjustment").

Figure 4:
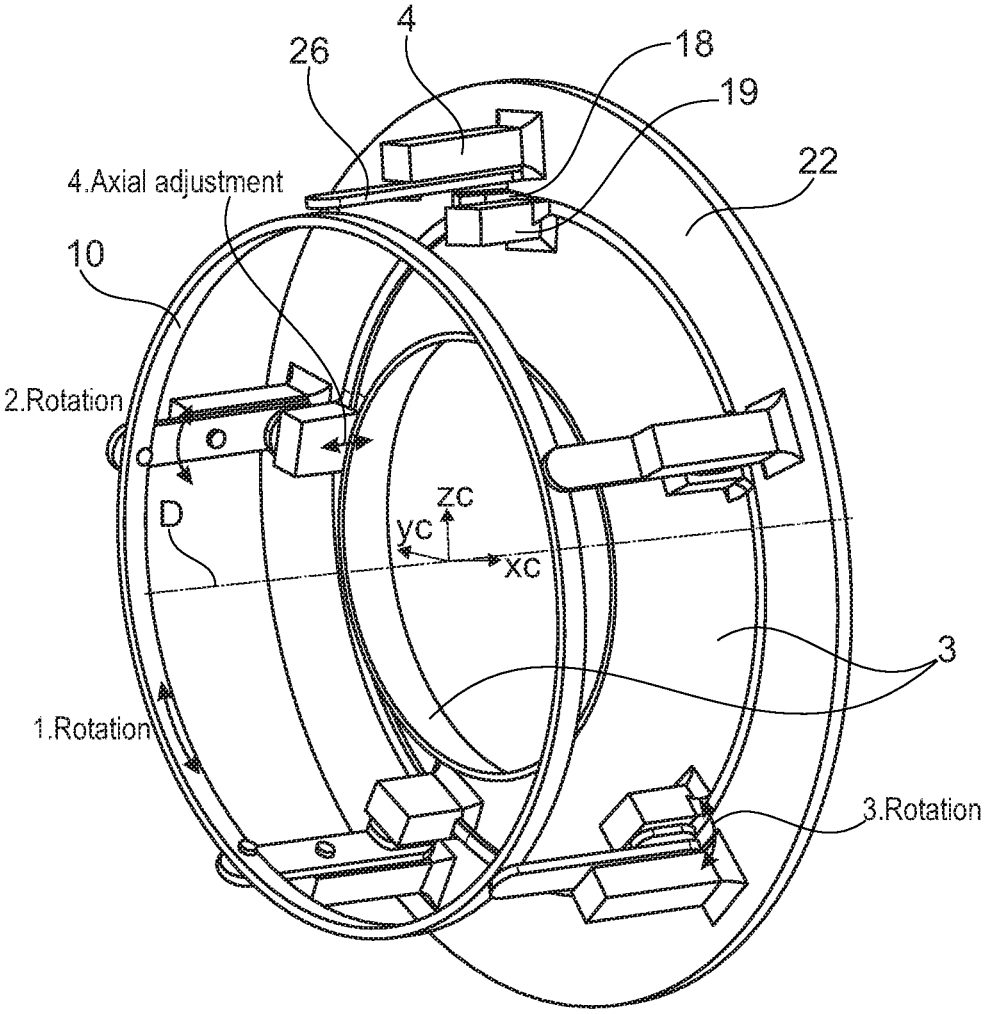
FIG. 4 shows a perspective view of an embodiment with setting devices and an adjusting ring that is movable around the rotational axis for an embodiment of a device for adjusting a gap, which is embodied as a tilting lever with a towing lever.

FIG. 4 shows a further embodiment of a device for adjusting the gap 21, which, apart from the tilting levers 26, also comprises towing levers 18. Besides, the synchronous actuation of the tilting levers 26 by the adjusting ring 10 is also effected in a different manner, since in addition to a movement around the rotational axis D the adjusting ring also moves in the axial direction.

The tilting levers 26 are respectively connected to a towing lever 18, which in turn is arranged at the setting device 20. FIG. 4 shows the adjusting ring 10 in a first working position, which is the position in which it has been moved farthest towards the rotor. If the adjusting ring 10 is set into rotation around the rotational axis D ("1. Rotation"), the tilting levers 26 are likewise set into rotation ("2. Rotation"). The tilting levers 26 set the towing levers 18 into rotation ("3. Rotation"), which then leads to an axial adjustment of the housing 3 ("4. Axial adjustment").

The towing levers 18 are respectively linked at the bearing blocks 19 on top of the housing 3 of the impeller 1, so that this housing 3 is set into an axial movement by the rotational movement, by means of which the gap 21 can be adjusted.

Thus, the setting device 20 of this embodiment has no shaft 6 with a thread 23 for translating a rotational movement into a linear movement, but rather a double-lever joint with a tilting lever 26 and a towing lever 18 that is attached at the housing 3 of the impeller 1 by means of a bearing block 19.

The adjustment lever devices 9 that are shown here (i.e., tilting levers 26 and towing levers 18) respectively act together with the adjusting ring 10 in order to adjust the gap 21. At that, the adjustment lever devices 9 can be designed in different manners.

Figure 5:
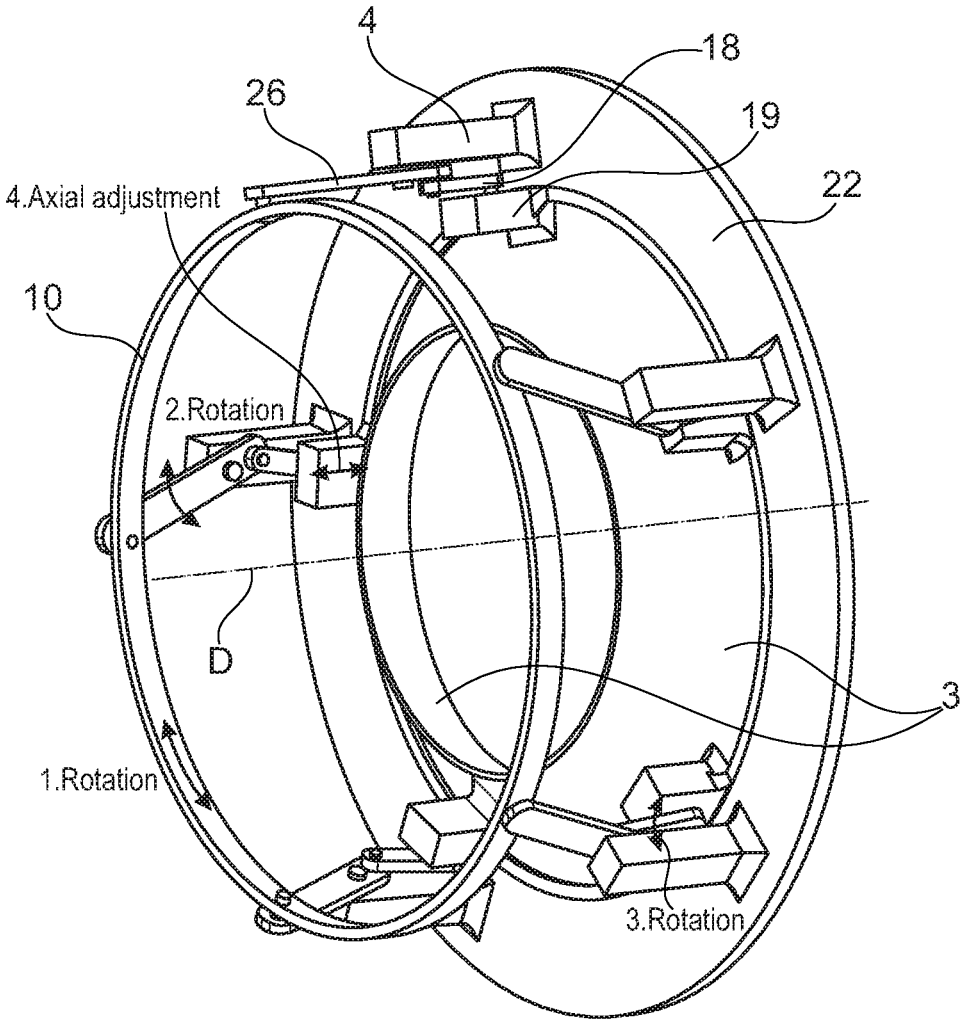
FIG. 5 shows a perspective view of a further embodiment with setting devices and an adjusting ring that is movable around the rotational axis, which is embodied as a tilting lever with a towing lever.

FIG. 5 shows an alternative variant according to FIG. 4, which, however, has shorter tilting levers 26. Otherwise, the description of FIG. 4 may be referred to.

Figure 6:
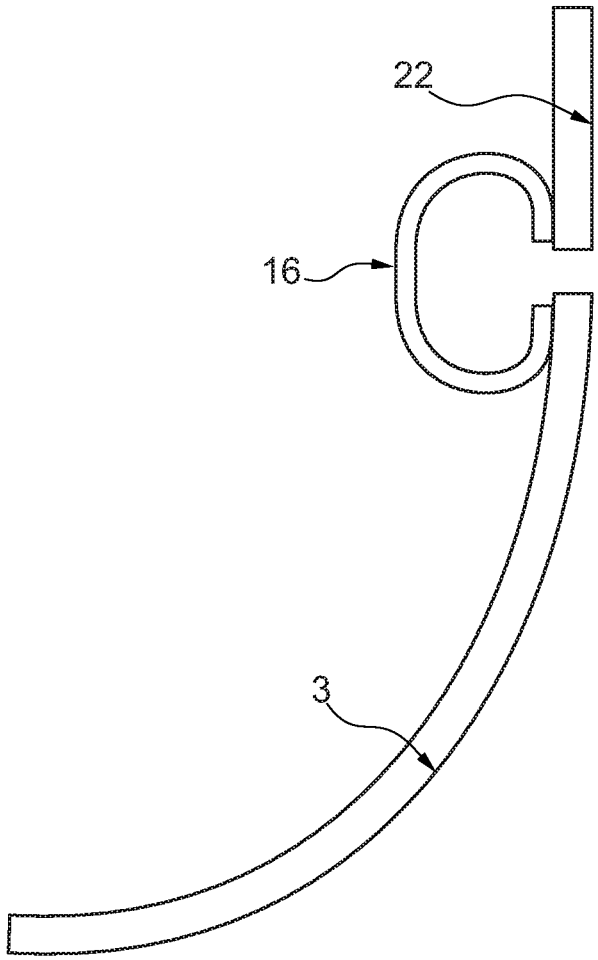
FIG. 6 shows a detailed view of a springy connection of the housing of the impeller with the radially connecting diffuser.

For avoiding or minimizing a rotation of the housing 3 of the impeller 1, a ring-shaped spring element 16 is provided that is arranged at the transition between the diffuser housing 22 and the housing 3 of the impeller 1. This is shown in FIG. 6. In an alternative embodiment, the spring element 16 can also be configured as an elastic full ring that seals the housing transition.

The embodiments of FIGS. 2 to 5 show that different adjustment lever devices 9 can be used in order to synchronously translate a movement of the adjusting ring 10 into an axial movement of the housing 3 of the impeller 1.

Figure 7:
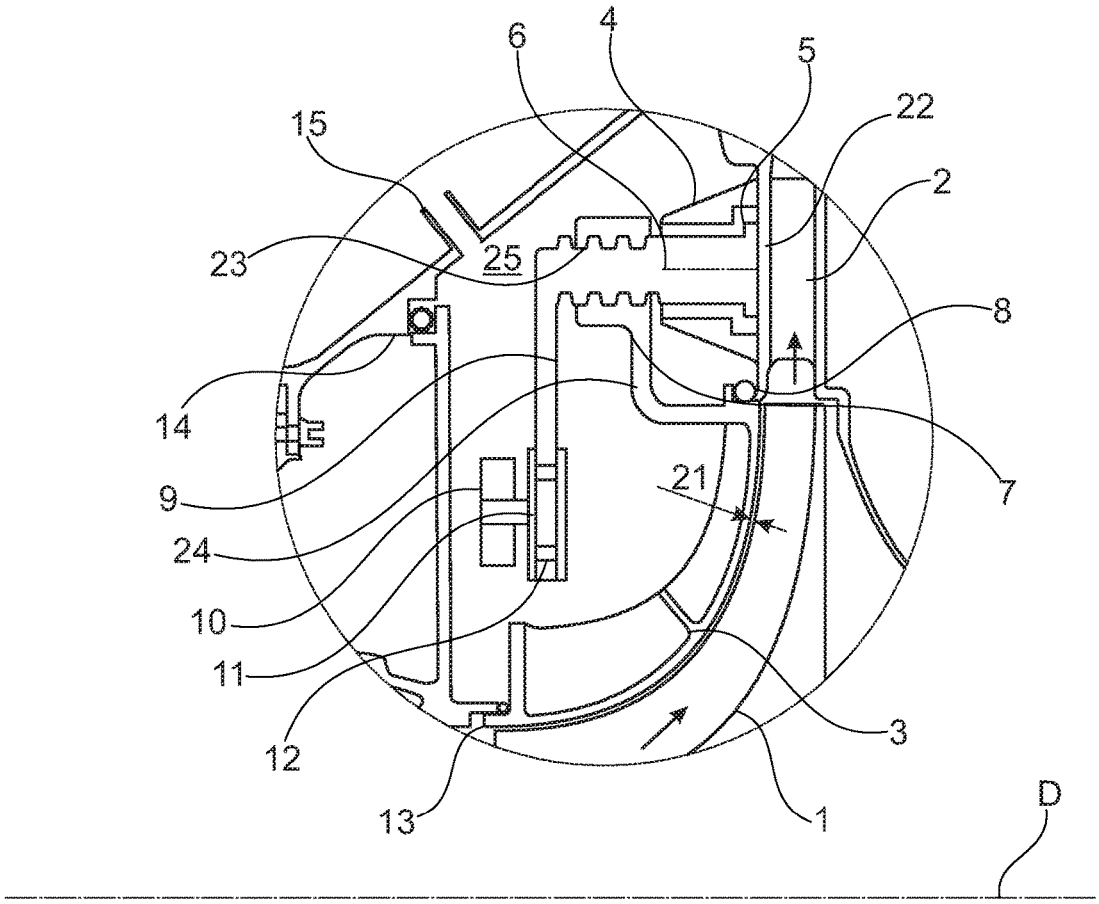
FIG. 7 shows a further embodiment of the device where a pressure chamber is being used.

FIG. 7 shows a modification of the embodiment according to FIG. 1, so that the above description may be referred to. In particular, the setting device 20 is the same, with the bearing block 4, the anti-friction bush 5, the shaft 6, the thread 23 and the nut device 7 being used. And also the actuation of the adjustment lever devices 9 via the adjusting ring 10 is effected in the same manner as is shown in FIGS. 2 and 3, for example.

In the embodiment according to FIG. 7, the setting device 20 for retaining the gap 21 is arranged inside a pressure chamber 25 that is surrounded by a pressure chamber wall 14.

Via a pressure line 14, the pressure chamber 25 can be set under excess pressure, so that a pressure difference between the radial compressor and the environment is created. Through the increased pressure, the setting device 20 can be dimensioned to be smaller and lighter. However, in principle it is also possible to arrange the setting device 20 outside of the pressure space 25.

The pressure build-up can for example be fed by the combustion chamber pressure or the compressor bleed air. The pressure can also be controllable, so that it can be adjusted to different operational states.

Alternatively, a setting device 20 with tilting levers 26 and towing levers 18 according to one of the embodiments in FIG. 4 and FIG. 5 can also be combined with a pressure chamber 25.

PARTS LIST

1 impeller of the radial compressor
2 diffuser
3 housing of the impeller
4 bearing block
5 anti-friction bush with flange
6 shaft with thread
7 nut device
8 seal
9 adjustment lever device, thread lever
10 adjusting ring for adjustment lever devices
11 slide stone
12 sliding guide or oblong hole in the thread lever
13 axial guidance and seal of the housing of the impeller
14 pressure chamber wall
15 access to pressure line
16 ring-shaped spring element
18 towing lever
19 bearing block on the housing of the impeller
20 setting device
21 gap
22 diffuser housing
23 thread
24 link of the nut device to the housing of the impeller
25 pressure chamber
26 tilting lever
D rotational axis of the impeller
K axial force for adjusting of the gap

The invention claimed is:

1. A device for adjusting a gap between an impeller and a housing of the impeller in a radial compressor of a turbomachine, comprising:

an impeller and a housing of the impeller;

a housing of a diffuser;

an adjusting ring;

at least one mechanical setting device supported by the housing of the diffuser, wherein the at least one mechanical setting device comprises a base portion located at the housing of the diffuser;

an adjustment lever with a first end and a second end, wherein the first end is connected to the adjusting ring, and wherein the second end is connected to the at least one mechanical setting device; and wherein a movement of the adjusting ring actuates the at least one mechanical setting device by at least one chosen from an axial transmission of force and a rotational motion of the adjustment lever, and wherein the movement of the adjusting ring axially repositions the housing of the impeller to adjust a gap between the impeller and the housing of the impeller.

2. The device according to claim 1, wherein the at least one mechanical setting device includes a plurality of mechanical setting devices, wherein the plurality of mechanical setting devices are synchronously adjustable in a targeted manner via the adjusting ring to adjust the gap between the impeller and the housing of the impeller.

3. The device according to claim 1, wherein the adjusting ring is arranged concentrically around a rotational axis of the impeller on a suction side of a radial compressor, wherein the adjusting ring is movable in a circumferential direction around at least one chosen from a rotational axis D and an axial direction relative to the housing of the impeller.

4. The device according to claim 1, wherein the adjustment lever is arranged so as to be movable in a plane perpendicular to a rotational axis of the impeller.

5. The device according to claim 1, wherein the adjustment lever is arranged so as to be movable parallel to a rotational axis of the impeller.

6. The device according to claim 1, wherein the at least one mechanical setting device includes a threaded shaft extending from the second end of the adjustment lever to the housing of the diffuser, and wherein the rotational motion of the adjustment lever is transferable to the threaded shaft to convert the rotational motion of the adjustment lever to an axial motion of the housing of the impeller.

7. The device according to claim 6, further comprising a bearing block, wherein the threaded shaft is supported by the bearing block at the housing of the diffuser.

8. The device according to claim 6, wherein the threaded shaft includes a thread configuration arranged around the threaded shaft, wherein the thread configuration is at least one chosen from a flat thread, a spiral groove guide, a trapezoidal thread, a buttress thread, and a round thread.

9. The device according to claim 8, further comprising a nut device, wherein the threaded shaft is arranged inside the nut device, wherein the nut device is coupled to a connection element for transmitting an axial force.

10. The device according to claim 1, wherein the adjustment lever includes a joint gear for converting an axial movement of the adjusting ring into an axial movement of the housing of the impeller.

11. The device according to claim 1, further comprising a spring device, wherein the spring device radially connects the housing of the diffuser to the housing of the impeller to avoid or minimize a rotational movement of the housing of the impeller.

12. The device according to claim 11, wherein the spring device is configured as a full ring spring that seals a transition between the housing of the diffuser and the housing of the impeller.

13. The device according to claim 1, wherein the at least one mechanical setting device includes a number of mechanical setting devices concentrically arranged uniformly around a rotational axis of the impeller, wherein the number is chosen from between three and twenty.

14. The device according to claim 1, wherein the housing of the impeller is mechanically coupled to a pressure chamber such that a pressure inside the pressure chamber contributes to adjusting the gap between the impeller and the housing of the impeller.

15. The device according to claim 14, wherein the at least one mechanical setting device is arranged at least partially inside the pressure chamber.

16. An aircraft engine, with a radial compressor that includes the device according to claim 1.

17. The device according to claim 10, wherein the joint gear is a double-jointed lever, wherein the double-jointed lever includes a tilting lever and a towing lever for converting an axial movement of the adjusting ring into an axial movement of the housing of the impeller.

18. The device according to claim 13, wherein the number of mechanical setting devices is chosen from between five and ten.

19. The device according to claim 1, wherein the base portion is an anti-friction base portion.

* * * * *